United States Patent [19]

Pacholke

[11] Patent Number: 4,715,972

[45] Date of Patent: Dec. 29, 1987

[54] SOLID LUBRICANT ADDITIVE FOR GEAR OILS

[76] Inventor: Paula J. Pacholke, 3420 Shenandoah Ave., Port Huron, Mich. 48060

[21] Appl. No.: 852,420

[22] Filed: Apr. 16, 1986

[51] Int. Cl.[4] ..... C10M 103/00; C10M 125/00

[52] U.S. Cl. ..... 252/25; 252/29; 252/30

[58] Field of Search ..... 252/29, 25

[56] References Cited

U.S. PATENT DOCUMENTS

| | | | |
|---|---|---|---|
| 3,062,741 | 11/1962 | Crowl | 252/25 |
| 3,156,420 | 11/1964 | Crowl | 241/16 |
| 3,300,459 | 1/1967 | Natta et al. | 526/348 |
| 3,384,580 | 5/1968 | Peace | 252/29 |
| 3,384,581 | 5/1968 | Peace | 252/29 |
| 3,842,009 | 10/1974 | Barry et al. | 252/25 |
| 4,136,040 | 1/1979 | DeVries et al. | 252/30 |
| 4,411,804 | 10/1983 | DeVries et al. | 252/29 |
| 4,417,991 | 11/1983 | Apikos | 252/29 |
| 4,434,064 | 2/1984 | Chao et al. | 252/29 |

*Primary Examiner*—William R. Dixon, Jr.
*Assistant Examiner*—Ellen M. McAvoy
*Attorney, Agent, or Firm*—Harness, Dickey & Pierce

[57] ABSTRACT

A lubricant additive for gear oils and an improved gear oil are disclosed. The additive comprises about 0.01 to about 65 percent, by weight, of solid lubricant particles selected from the group consisting of molybdenum disulfide, graphite, cerium fluoride, zinc oxide, tungsten disulfide, mica, boron nitrate, boron nitride, borax, silver sulfate, cadmium iodide, lead iodide, barium fluoride, tin sulfide, fluorinated carbon, PTFE, intercalated graphite, zinc phosphide, zinc phosphate, and mixtures thereof; combined with about 0.1 to about 25 percent, by weight, of a stabilizing agent consisting of an ethylene-propylene copolymer; and a fluid carrier. The lubricant additive provides the gear oil with improved demulsibility, stability, and compatibility characteristics of the gear oil when contaminated with water.

1 Claim, No Drawings

SOLID LUBRICANT ADDITIVE FOR GEAR OILS

BACKGROUND OF THE INVENTION

The use of solid lubricant additives in gear oils as antiwear and extreme pressure agents is well known to those in the lubrication field. These solids lubricant additives have been added to the gear oil as a stable dispersion and it is desireable that they remain stable in order for these benefits to be realized. When gear oils containing conventionally dispersed solid lubricants are used in gear systems which are exposed to water contamination, the gear oil tends to completely emulsify the water holding it in the oil. This condition is highly undesireable because it predisposes the gears to corrosive pitting and other ramifications of improper lubrication. In conventional gear oils, the removal of the emulsified water from the oils is accomplished by adding special demulsification agents to the oil. Demulsification is the separation of water droplets from a gear oil to form a separate and distinct layer or phase which can be removed from the gear box. In the case of lubricants which contain dispersed solid lubricant additives, the incorporation of such demulsification agents frequently results in flocculation of the solid particles. The flocculation of the solid lubricant particles causes them to separate from the oil by settling thus removing the additive from the oil; the benefits gained from the incorporation of solid particles in the oil are thus lost.

Therefore there is a need in the field for a solid lubricant additive, which, when incorporated in a gear oil used in water contaminated environments, would allow the lubricating solids to remain dispersed in the oil and impart the known benefits of lubricating solids and provide for the removal of emulsified water.

The object of the present invention is to provide a solid lubricant additive for gear oils. The unique character of this additive is that it not only exhibits outstanding dispersion quality, but also has the demulsibility characteristics required for field use and retains the outstanding dispersion quality even in the presence of water contamination.

The use of solid lubricant additives is known in the art.

U.S. Pat. No. 3,384,581, issued May 21, 1968, discloses a composition comprising a particulate material dispersed in a fluid organic material and contained a stabilizing agent. The stabilizing agent disclosed is an ethylene-propylene copolymer or terpolymer. The solid lubricant additive disclosed in this patent was intended to provide enhanced stability of the particulate material at elevated temperatures.

U.S. Pat. No. 3,384,580, issued May 21, 1968, discloses a stabilized dispersion comprised of graphite dispersed in a fluid organic carrier material and contains a stabilizing agent for dispersing the graphite throughout the mixture. The stabilizing agent which is utilized is an ethylene-propylene copolymer or terpolymer and was used to give better high temperature stability to the dispersed graphite.

U.S. Pat. No. 3,062,741, issued Nov. 6, 1962, discloses an improved molybdenum disulfide lubricant in particulate for and a method for making the same and to dispersions containing such improved lubricants. The invention comprises molybdenum disulfide particles having a mass mean diameter of about 0.45 microns to about 2 microns and at least 99.9 percent by weight of the particles having a diameter of less than 32 microns.

U.S. Pat. No. 3,156,420, issued Nov. 10, 1964, discloses an improved molybdenum disulfide lubricant in particulate form, a method of making this lubricant and dispersions containing such improved lubricants. The invention further comprises a method for making finely divided molybdenum disulfide which comprises the steps of grinding molybdenum disulfide in the presence of a compatible grinding aid selected from the group consisting of salicyclic acid and phthalic anhydride.

U.S. Pat. No. 3,842,009, issued Oct. 15, 1974, discloses a liquid lubricant composition comprising a homogeneous stable suspension of finely particulated molybdenum disulfide in a base oil incorporating a dispersant. The dispersant comprises a specific copolymer of methacrylate ester and n-vinyl pyrrolidone. These elements are present in controlled proportions relative to the quantity of molybdenum disulfide present.

U.S. Pat. No. 4,417,991, issued Nov. 29, 1983, discloses a graphite automotive gear oil containing extreme pressure additives. The presence of the extreme pressure agents in the gear oil created a tendency of the oil composition to thicken in use. The use of a dispersant consisting of an ethylene-propylene copolymer grafted with a nitrogen containing vinyl functionality selected from the group consisting of an n-vinyl pyrrollidone and an n-vinyl pyridine.

U.S. Pat. No. 4,136,040, issued Jan. 23, 1979, discloses an improved lubricating oil composition comprising an oil of lubricating viscosity, a minor amount by weight of solid particles to effect improved lubricating properties of the composition, and a minor amount of a nitrogen-containing mixed ester of a carboxy-containing interpolymer. Generally, a nitrogen containing mixed ester of a carboxy containing interpolymer is a polymer which has a reduced specific viscosity in the range from about 0.05 to about 2, and is characterized by the presence of at least one of each of three pendant polar groups within its polymeric structure: (A) a high molecular weight carboxylic ester group which has at least eight (8) aliphatic carbon atoms in the ester radical; (B) a low molecular weight carboxylic ester group with no more than seven (7) aliphatic carbon atoms in the ester radical; and (C) a select carbonyl-polyamino group. This composition provides improved inhibition of sludge and varnish formation in use in engine oils.

U.S. Pat. No. 4,411,804, issued Oct. 25, 1983, discloses an improved lubricating oil composition comprising an oil of lubricating viscosity, a small amount by weight of solid lubricating particles, and a minor amount of certain dispersant-VI improvers. Generally, the solid particles were selected from the group consisting of graphite, molybdenum disulfide, zinc oxide, and mixtures thereof. This composition was intended to provide improved inhibition of sludge and varnish formation in automotive engine use.

U.S. Pat. No. 4,434,064, issued Feb. 28, 1984, discloses a method for stabilizing a graphite in oil dispersion by means of a fracture induced oxidation of graphite particles. The oxidized graphite particles produce a composition suitable as a constituent of the lubricating oil composition. The oxygen content of the graphite particles is at least about one percent by weight of the total weight of the ground graphite particles included in oxygen.

Thus, the art has recognized that solid lubricant additives incorporated in conventional lubricants give the lubricant enhanced anti-wear properties, load carrying capacity, and can also decrease energy consumption. However, it has been surprisingly discovered that the addition of a solid lubricant additive, comprised of a solid lubricant in the presence of an ethylene-propylene copolymer and organic fluid carrier, to a gear oil exhibits excellent dispersion of the solid particles and outstanding water demulsibility characteristics. The additive is generally intended for use in water contaminated environments or in environments in which the potential of water contamination exists.

SUMMARY OF THE INVENTION

The present invention relates to a solid lubricant additive for gear oils. The benefits and advantages of the present invention are achieved by providing a solid lubricant additive which, when added to a gear oil, exhibits outstanding dispersion and demulsibility characteristics.

In practice of the instant invention, the solid lubricant component of the additive composition is selected from the group consisting of molybdenum disulfide, graphite, cerium fluoride, zinc oxide, tungsten disulfide, mica, boron nitrate, boron nitride, borax, silver sulfate, cadmium iodide, lead iodide, barium fluoride, tin sulfide, PTFE, fluorinated carbon, intercalated graphite, zinc phosphide, zinc phosphate, mixtures thereof and the like, a stabilizer, comprised of an ethylene-propylene copolymer which are elastomeric compounds produced by the polymerization of ethylene and propylene monomers, and a fluid carrier. In a preferred embodiment, the ethylene-propylene copolymer would have substantially equal proportions of ethylene and propylene monomers and an average molecular weight of from about 22,000 to about 200,000. Other useful polymeric materials are the elastomeric compounds or terpolymers produced by the addition copolymerization of ethylene and propylene monomers with a minor proportion of an uncongugated diene. These elastomeric materials are commonly known as ethylene-propylene-diene terpolymers.

The additive is added to a lubricant system such as commercial gear oils, conveyor chain lubricants, way oils, or penetrating oils to provide the lubricants with improved and effective demulsification of water from the oil in the presence of dispersed lubricating solids. The above systems may also be aerosolized. In a preferred embodiment, the lubricating solids are selected from the group consisting of molybdenum disulfide and graphite. In another preferred embodiment, the molybdenum disulfide or graphite is mixed with an ethylene-propylene copolymer in a ratio of solid lubricant: stabilizer of from about 25:1 and preferably about 4:1.

The solid lubricant additive concentrate is then added to a conventional gear oil. In a preferred embodiment, the solid lubricant is present in the final gear oil composition in an amount of from about 0.1 to about 10.0 percent, more preferably about 0.1 to 5.0 percent, by weight of the final gear oil composition.

Additional benefits and advantages of the present invention will become apparent upon reading the detailed description of the invention taken in conjunction with the specific examples provided and the claims.

DETAILED DESCRIPTION OF THE INVENTION

The solid lubricant additive of the present invention employs a small particles of a lubricating solid, a stabilizing agent and a fluid carrier. Also, the present invention further comprises a gear oil combined with an effective amount of a solid lubricant additive. The additive of the present invention added to a conventional gear oil composition provides the gear oil with a required degree of demulsification of water in the gear oil, while also providing the gear oil with dispersed solid lubricants.

By the term "demulsibility", as used herein, it is meant the ability of a water-contaminated gear oil to separate the water from the oil within a specified time period; reference may be made to preferred demulsibility requirements of gear oils as specified in United States Steel Specification 224, incorporated herein by reference; and as evaluated and tested by the American Society of Testing and Materials Standard Method D-2711, also incorporated herein by reference. This, test determines the amount of water which will separate from the gear oil within the time and test constraints of the method and determines whether or not the gear oil composition is particularly suited for use in water contaminated environments.

By the term "dispersion", as used herein, it is meant a mixture which includes solid lubricating particles, a stabilizer and a carrier fluid in which the lubricating particles remain as separate and discrete particles within the carrier medium for extended periods of time, i.e. several months.

The unique solid lubricant additives of the present invention include solid lubricants selected from the group consisting of graphite, molybdenum disulfide, cerium fluoride, zinc oxide, tungsten disulfide, mica, boron nitrate, boron nitride, borax, silver sulfate, cadmium iodide, lead iodide, barium fluoride, tin sulfide, fluorinated carbon, PTFE, intercalated graphite, zinc phosphide, zinc phosphate, mixtures thereof and the like. By the term "fluorinated carbon", as used herein, it is meant a carbon-based material such as graphite which has been fluorinated to improve its aesthetic characteristics. Such materials include, for example, a material such as $CF_x$ wherein x ranges from about 0.05 to about 1.2. Such a material is produced by Allied Chemical under the tradename Accufluor. In a preferred embodiment, molybdenum disulfide and graphite are used.

When employed in the compositions and methods of the present invention the molybdenum disulfide has an average particle size ranging from about 0.001 to about 100 microns, preferably from about 0.001 to about 25 microns, and more preferably, from about 0.001 to about 7.0 microns. The particle size range of molybdenum disulfide is selected according to the lubrication requirements of a particular application.

When a graphite is employed in the compositions and methods of the present invention, the graphite may be obtained from either naturally occuring sources or can be an electric furnace graphite. Generally, graphite employed has a particle size ranging from about 0.001 to about 100 microns, preferably from about 0.001 to about 25.0 microns, and more preferably from about 0.001 to about 10.0 microns.

The solid lubricant is employed in the additive compositions of the present invention at a level from about 0.01 to about 65.0 percent. The final selection of a level from this useful range will of course depend upon the application required and the selection of such a level is well within the skill of the artisan. The additive composition, containing the above concentration of solid lubricant particles, may conveniently be added to a gear oil composition to provide an effective amount of solid lubricant ranging from about 0.001 to about 15.0 percent, preferably about 0.2 to about 5.0 percent, and more preferably from about 0.5 to about 1.0 percent by weight of the final gear oil composition. The specific concentration and the particle size distribution of the solid lubricant present in the gear oil may be varied as required by the specific conditions relating to the frictional and loading requirements of the gear system in operation such selection is again well within the skill of the artisan. In most instances, when molybdenum disulfide is incorporated in a conventional gear oil in concentrations from about 0.1 to about 5.0 percent, distinct improvements in anti-wear and load-bearing capabilities are observed when compared to a gear oil without such an additive. Similarly, in most instances, graphite concentrations of about 0.1 percent to about 5.0 percent of the final gear oil composition have been found to provide improved performace over the conventional, untreated oil.

The stabilizing agents used in the compositions and methods of the present invention are selected from the group consisting of ethylene-propylene copolymers having substantially equivalent proportions of ethylene and propylene monomers. The ethylene-propylene copolymer has an average molecular weight in the range of about 22,000 to 200,000 preferably 22,000 to about 40,000. Generally, the amount of stabilizing agent required to satisfactorily disperse the solid lubricant and provide the desired demulsification characteristics varies with the particle size and type of the solid lubricant and the character of the dispersion medium. It has been found that satisfactory dispersion of the solid lubricant and demulsification of water from a gear oil, in which the solid lubricant additive composition has been incorporated, can be produced with a stabilizing agent present from about 0.1 to about 25.0 percent, preferably from about 2.0 percent to about 7.0 percent, and more preferably about 3.0 to about 5.0 percent, by weight of the additive composition. The additive composition, containing the above range of concentrations of stabilizing agent, may conveniently be added to a fluid or fluid-like lubricant such as a gear oil to provide a final composition containing an effective amount of stabilizing agent. Preferred amounts are at levels of from about 0.001 to about 10.0 percent, preferably about 0.01 to about 5.0 percent, and more preferably from about 0.01 to about 3.0 percent by weight of the final gear oil composition. The additive composition is added to the gear oil as an additive composition as described. Randomly or unilateral additions of the solid lubricant particles and a stabilizing agent to a fluid or fluid-like lubricant each as a gear oil will not impart demulsibility, the desired dispersion, stability or compatibility characteristics. While greater percentages (by weight) may be employed, such increased levels of the stabilizing agent(s) appear to cause the additive to become extremely viscous and processing and handling become impractical. Furthermore, increasing the percentage of the stabilizing agent beyond the indicated range does not significantly improve the dispersion quality of the additive composition nor does it improve the demulsibility characteristics of the gear oil composition in which the solid lubricant additive is incorporated.

Thus, a preferred ratio of solid lubricant to the stabilizing agent can be employed of from about 25:1 to about 4:1, preferably between about 10:1 to about 4:1, and more preferably about 10:1 to about 5:1. Generally, concentrations of an ethylene-propylene copolymer, when used as the preferred stabilizing agent, may be in the range from about 0.01 to about 25.0 percent, preferably about 0.1 to about 15.0 percent, and more preferably from about 1.0 to about 5.0 percent by weight of the additive composition. These preferred ranges provide optimum dispersion stability and provide significant improvements in the water demulsifying abilities of gear oils incorporating the solid lubricant additive.

In forming a solid lubricant additive or concentrate, a carrier fluid is usually employed for the convenient and complete mixing and transportation of the concentrated additive. Generally, the carrier is an organic fluid or solvent, such as a petroleum oil, but other carrier fluids have been found to be satisfactory, including vegetable oils such as rapeseed oil; liquid hydrocarbons such as aliphatic and aromatic naphthas and mixtures thereof; synthetic lubricant fluids such as polyalphaolefins, polyglycols, diester fluids, mixtures of these liquids and the like. The selected carrier fluid may comprise the balance of the final additive composition containing the solid lubricant and stabilizing agent. The carrier fluid chosen for the additive preferably mixes completely with the gear oil, in which the solid lubricant additive will be incorporated, in order to ensure optimum stability of the dispersed solids and may be selected to provide any special lubrication requirements of the particular gear system application.

A solid lubricant additive is generally formed by mixing the solid lubricant with the stabilizing agent in the presence of the carrier. The particle size and concentration of the solid lubricant as well as the carrier fluid are chosen to best suit the requirements of the intended application. The dispersion of solid lubricants in fluid media is accomplished by intensively mixing the solid lubricant with the chosen stabilizing agent and the carrier fluid. Such dispersion methods are well known to those in the art of making dispersions of solid pigments and the like.

The viscosity of the formed solid lubricant additive may range up to about 500,000 centipoise, depending upon the intended application. The additive concentrate is then added to a conventional gear oil and is mixed to ensure homogeneity. A gear oil of the present invention containing the additive of the present invention exhibits outstanding demulsibility characteristics when used in gear systems in which water contamination is present, and exhibits excellent dispersion of the solid lubricant even in the presence of water.

In order to further illustrate the benefits and advantages of the present invention, the following specific examples are provided. It will be understood that the examples are provided for illustrative purposes and are not intended to be limiting to the scope of the invention as herein disclosed and set forth in the claims.

EXAMPLE 1

One hundred parts of molybdenum disulfide particles ranging in average particle size from about 0.001 to about 25.0 microns were placed in a suitable mixer with twenty (20) parts of an ethylene-propylene copolymer chosen according to the specifications of such copolymers described herein. The combination, which had the consistency of a stiff paste was allowed to mix for a minimum time of six (6) hours. One-hundred (100) parts of a solvent-refined neutral petroleum oil were added to the mixture in small increments, with mixing between additions, and further mixing for fifteen (15) minutes at the end of the addition period to insure uniformity of the dispersion. The dispersion was in the form of a viscous fluid when removed from the mixer. The dispersion was then evaluated as a solid lubricant additive incorporated in a conventional gear oil formulation for dispersion stability and demulsibility characteristics, see Table 1.

EXAMPLE 2

One hundred (100) parts of electric furnace graphite (99+ percent graphitic carbon content), with an average particle size range from about 0.001 to about 25 microns were placed in a mixer with twenty-five (25) parts of an ethylene-propylene copolymer as described herein. The combiantion was mixed for a minimum of six (6) hours and had the consistency of a stiff paste. At the end of this mixing period, one-hundred (100) parts of a solvent-refined neutral petroleum oil were added to the mixture in small increments, with mixing between additions, and with further mixing for fifteen (15) minutes after the final amount had been added to insure homogeneity of the dispersion. The dispersion had the consistency of a viscous fluid when it was removed from the mixer, and was evaluated as a solid lubricant additive incorporated in conventional gear oil composition for dispersion stability and demulsibility characteristics, see Table 1.

EXAMPLE 3

One-hundred (100) parts of molybdenum disulfide particles ranging in average particle size from about 0.001 to about 25.0 microns were placed in a mixer with ten (10) parts of an ethylene-propylene copolymer. The mixture was mixed for a minimum period of six (6) hours and had the consistency of a stiff paste. At the end of the mixing period, one-hundred (100) parts of a solvent-refined neutral petroleum oil were added to the mix in small increments, mixing between additions and with further mixing for fifteen (15) minutes at the end of the addition period. The dispersion was removed from the mixer and had the consistency of a viscous fluid. Tests were performed on a conventional gear oil composition which incorporated the dispersion as a solid lubricant additive to evaluate the dispersion stability and demulsibility characteristics of the resulting composition. The results were satisfactory and are given in Table 1.

EXAMPLE 4

The solid lubricant additive prepared as in Example 1 was incorporated into a conventional gear oil composition to provide a concentration of molybdenum disulfide of 1.0 percent by weight of the gear oil composition. The resulting gear oil composition was then subjected to dispersion stability and demulsibility tests. The results of these tests were satisfactory and given in Table 1.

EXAMPLE 5

The solid lubricant additive as prepared in Example 2 was incorporated in a conventional gear oil as 1.0 percent graphite by weight of the composition. The resulting gear oil composition was tested for the stability of the graphite dispersion and for the demulsibility characteristics of the gear oil composition. The satisfactory results of these tests are given in Table 1.

EXAMPLE 6

The solid lubricant additive as prepared in Example 1 was incorporated at 1.0 percent molybdenum disulfide by weight of the total gear oil composition into a conventional gear oil comprised of a petroleum oil of lubricating viscosity, and 3.5 percent by weight of the composition of a commercially available sulphur-phosphorus extreme pressure additive. The satisfactory results of the dispersion stability and demulsibility tests are shown in Table 1.

EXAMPLE 7

A commercially available molybdenum disulfide dispersion comprised of stable dispersed molybdenum disulfide, extreme pressure additives, and carrier oil, was incorporated into a conventional gear lubricant in the amount necessary to provide 1.0 percent molybdenum disulfide by weight of the gear oil composition. The dispersion stability and demulsibility tests showed that this composition was unsatisfactory for use in water contaminated gear systems. These results are also given in Table 1.

TABLE 1

| Example | % Solids | Stabilizer | Stability | Demulsibility |
|---|---|---|---|---|
| 1 | 20.0 | ethylene-propylene copolymer | good | not applicable to additive concentrates. |
| 2 | 10.0 | ethylene-propylene copolymer | good | not applicable to additive concentrates. |
| 3 | 20.0 | ethylene-propylene copolymer | good | not applicable to additive concentrates |
| 4 | 1.0 | — | good | excellent, complete separation of water from oil within 5 hours as required by test method. |
| 5 | 1.0 | — | good | excellent, complete separation of water from oil within 5 hours as required by test method. |
| 6 | 1.0 | — | good | excellent, complete separation of water from oil within 5 hours as required by test method. |
| 7 | 1.0 | copolymer of methacrylate | poor | no separation of water from oil after 5 hours. |

While it will be apparent that the preferred embodiments of the invention disclosed are well calculated to fulfill the objects stated above, it will be appreciated that the invention is susceptible to modification, variation and change without departing from the proper scope or fair meaning of the claims.

What is claimed is:

1. A method for demulsifying contaminant water out of gear oil as determined by ASTM test D-2711 by adding to said gear oil a composition consisting essentially of:

about 0.01 percent to about 65 percent by weight of the additive composition of solid lubricant particles selected from the group consisting of molybdenum disulfide, graphite, cerium fluoride, zinc oxide, tungsten disulfide, mica, boron nitrate, boron nitride, borax, silver sulfate, cadmium iodide, lead iodide, barium fluoride, tin sulfide, fluorinated carbon, PTFE, intercalated graphite, zinc phosphide, zinc phosphate, and mixtures thereof;

about 0.01 to about 25 percent by weight of the additive composition, of a stabilizing agent consisting essentially of an ethylene-propylene copolymer consisting of approximately equivalent proportions of ethylene and propylene monomers;

and a suitable fluid carrier, and demulsifying said contaminant water.

* * * * *